US005562412A

United States Patent [19]

Antonelli

[11] Patent Number: 5,562,412

[45] Date of Patent: Oct. 8, 1996

[54] FAN BLADE WITH FILTER

[76] Inventor: Carl Antonelli, 92 Erie St., Providence, R.I. 02908

[21] Appl. No.: 598,074

[22] Filed: Feb. 7, 1996

Related U.S. Application Data

[63] Continuation-in-part of Ser. No. 326,846, Oct. 21, 1994, abandoned.

[51] Int. Cl.[6] ..... F04D 29/70

[52] U.S. Cl. ..... 416/62; 416/5; 416/231 B

[58] Field of Search ..... 416/62, 5, 146 R, 416/231 B

[56] References Cited

U.S. PATENT DOCUMENTS

| | | | |
|---|---|---|---|
| 4,422,824 | 12/1983 | Eisenhardt, Jr. | 416/5 |
| 4,676,721 | 6/1987 | Hardee | 416/62 |
| 4,753,573 | 6/1988 | McKnight | 416/62 |
| 4,840,650 | 6/1989 | Matherne | 416/62 |
| 4,889,543 | 12/1989 | Burt | 416/62 |
| 5,022,819 | 6/1991 | Murcin et al. | 416/62 |
| 5,341,565 | 8/1994 | Kuryliw | 416/5 |
| 5,370,721 | 12/1994 | Carnahan | 416/62 |

*Primary Examiner*—Edward K. Look
*Assistant Examiner*—Michael S. Lee

[57] ABSTRACT

A fan apparatus with a filter affixed to one or more of its fan blades such that the rotating fan blades carry the filter or filters through a medium to extract pollutants.

2 Claims, 1 Drawing Sheet

FAN BLADE WITH FILTER

This application is a continuation-in-part, of application Ser. No. 08/326846, filed Oct. 21, 1994, now abandoned.

BACKGROUND OF THE INVENTION

1. Field of the Invention

This invention in general relates to fans but in particular to a simplified process with a means of retrofitting one or more blades of the fan with a filter to extract pollutants from a medium through which fan blades rotate.

2. Prior Art

Fans are commonplace as a means of directing air for purposes of ventilation. There is no other function for ceiling fans as they are now constituted. This invention provides a means that will improve their usefulness significantly. They can be retrofitted to operate in mediums other than air and fans could be set against walls or on floor stands but the filter will perform as long as blades are rotating. This invention will also reduce the amount of dust that normally accumulates on fan blades.

SUMMARY OF INVENTION

The primary object of this invention is to provide a filter for one or more fan blades to remove particular matter such as dust, pollen and insects from a volume of air, gas or fluid that goes through the filter or filters when the fan is driven by a means of rotation.

Fans of prior art have no filtering action and are simply designed to move air in some direction for purposes of ventilation. This invention requires the application of a filter with or without a case to one or more fan blades with some means of attachment that will hold the filter securely in place; a velcro fiber fastener is a good means of attachment placed between the filter case and the fan blade. The filter case can be made decorative. Further, if the fan blade is constructed with a slot into which the filter can be inserted, and if the filter is cut to have tapered sides, upon insertion the filter will not fall through the slot which will serve as a means to hold the filter securely. In another embodiment, the filter is secured with Velcro® on one side.

If rotation of the fan blade is at a nominal speed of 200 revolutions per minute, the tangential velocity of the blade tip will be 200×2×20 if the blade length is 20 inches. If the inch unit is converted to the foot unit, the velocity of the blade tip is 2048 feet per minute. If the filter length along the blade is half the length of the blade (the tangential velocity becomes less at distances closer to the center of rotation) so the average tangential velocity along the length of the filter as it bites into the air will be 1570 feet per minute. If the area of the filter biting into the air is 20 square inches or 0.14 square feet, the volume of air being filtered through is 1570×0.14 or 219.8 cubic feet per minute. This is a significant amount by one small filter or one ceiling fan blade.

BRIEF DESCRIPTION OF DRAWINGS in the drawings, like reference symbols indicate the same parts throughout the various views of the system, a specific embodiment of the invention or modification thereto.

FIG. 1 illustrates a typical fan modified with this invention; note the attachment of an air filter case 1 secured by velcro tabs 3. This figure also illustrates a preferred embodiment of this invention.

FIG. 2 is a frontal view of a fan blade illustrating attachment of the filter case 1 and the filter 4, the velcro tabs 3.

FIG. 3 illustrates a fan blade 2 constructed to have filter case 1, blade slot 7, filter support 6; said support can be decorative.

FIG. 4 illustrates a cross sectional view of a fan blade 2 constructed with a slot 7 to secure the filter 4 with case 1 for said filter.

FIG. 5 illustrates a filter attached with one Velcro member, the filter itself acting as the other Velcro® member.

DESCRIPTION OF PREFERRED EMBODIMENTS

Figure 1:
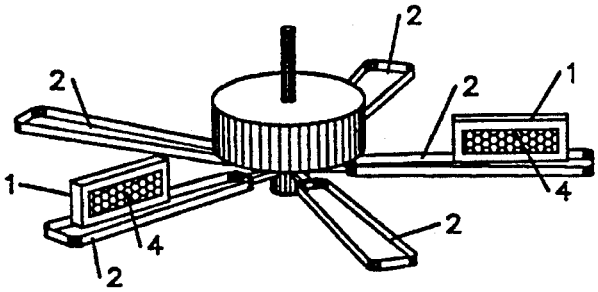

Refer to FIG. 1 which is an overall drawing of the preferred embodiment of this invention. This prespective drawing of a typical ceiling fan has blades 2, a filter case 1 to contain each of the said filters where they are installed on respective blades by velcro fasteners not shown in FIG. 1 and motor drive 5.

Figure 2:
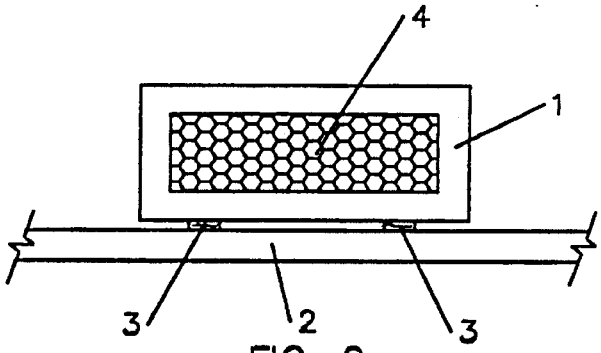
Figure 3:
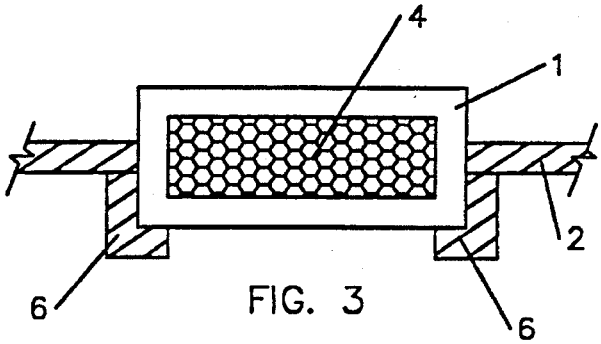

FIG. 2 is a frontal view of a fan blade 2 constructed to hold a filter case 1, the filter 4 and the velcro fastener tabs 3. A common fan blade can be retrofitted with this invention by attachment of filter case 1 and filter 4. Some other means of attachment such as elastic bands wrapped around the filter case 1 and the fan blade 2.

Figure 4:
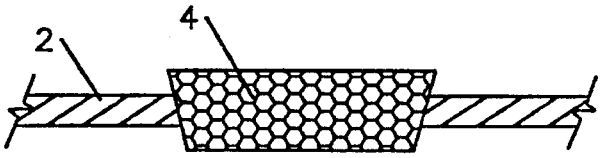

FIG. 4 is another means of implementing this invention. By shaping the filter case 1 and filter 4 in the form of a wedge that could be inserted into an appropriately sized slot in the fan blade 2 that will support the said filter case and said filter when rotation occurs.

Figure 5:
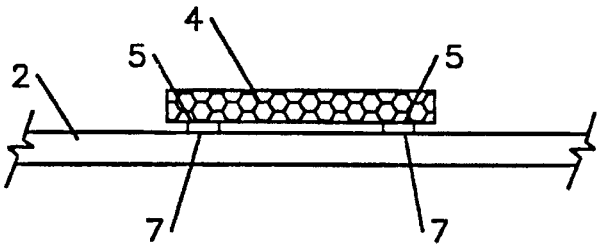

FIG. 5 shows yet another embodiment of the present invention. Velcro® fasteners are generally comprised of two members: a hook member and a loop member. In this embodiment, one of the two Velcro® members 5 (either the hook or loop) is attached to the fan blade 2 and the filter 4 is designed in a way that allows the filter itself to act as the other complementary member. In an exemplary embodiment, an adhesive 7 is used to attach one of the Velcro® members to the fan blade. But any other fastening system can be employed such as nails, screws or staples to attach one of the Velcro® members to the fan blade.

Because an entire joint is eliminated, this arraignment has several advantages: it provides for a more reliable joint because there is one less joint that can fail, it is also more economical because one of the Velcro® members is no longer needed.

The said slot can hold a rigid filter making the filter case unnecessary and further the filter can be used as an air freshener if it is appropriately treated.

I claim:

1. A fan apparatus comprising:

a motor to rotate a fan blade;

said blade constructed with a wedge shaped slot;

a wedge shaped filter disposed in said wedge shaped slot;

said wedge shaped slot formed in a manner which allows said wedge shaped slot to support said wedge shaped filter.

2. A fan apparatus comprising:

a motor to rotate a fan blade;

a filter attached to said blade by a fastener;

said fastener comprising first and second complementary members of a hook and loop fastener;

said first member being attached to said blade;

said filter itself designed to serve as said second complementary member.

* * * * *